US006457850B2

(12) United States Patent
Oyama et al.

(10) Patent No.: US 6,457,850 B2
(45) Date of Patent: Oct. 1, 2002

(54) VEHICLE LAMP

(75) Inventors: Hiroo Oyama, Sagamihara; Takashi Akutagawa; Yoshifumi Kawaguchi, both of Kawasaki; Go Adachi, Tokyo, all of (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/816,136

(22) Filed: Mar. 26, 2001

(30) Foreign Application Priority Data

Mar. 31, 2000 (JP) ..... 2000-097012

(51) Int. Cl.[7] ..... F21V 7/00

(52) U.S. Cl. ..... 362/517; 362/347; 362/298; 362/346; 359/858; 359/869

(58) Field of Search ..... 362/516–518, 362/347, 297–299, 303, 346; 359/850–866, 869

(56) References Cited

U.S. PATENT DOCUMENTS

| | | | | |
|---|---|---|---|---|
| 3,914,593 A | * | 10/1975 | Laribe | 240/41.35 R |
| 4,089,047 A | * | 5/1978 | Luderitz | 362/297 |
| 4,408,266 A | * | 10/1983 | Sclippa | 362/297 |
| 4,425,604 A | * | 1/1984 | Imai et al. | 362/223 |
| 4,816,875 A | * | 3/1989 | Takeda et al. | 355/67 |
| 4,956,759 A | * | 9/1990 | Goldenberg et al. | 362/297 |

FOREIGN PATENT DOCUMENTS

| | | |
|---|---|---|
| JP | 2000-76907 | 3/2000 |
| JP | 2000-182411 | 6/2000 |

* cited by examiner

*Primary Examiner*—Alan Cariaso
*Assistant Examiner*—Sharon Payne
(74) *Attorney, Agent, or Firm*—Morgan, Lewis & Bockius LLP

(57) ABSTRACT

A vehicle lamp can include a tube-like lamp element that has an aperture, a reflector having a focus located approximately at the aperture, and a front lens. The lamp can be disposed in a vehicle body space that has a small width from the front view and a small depth from a side view of the vehicle body. A blind or shade is not necessary to cover non-aesthetic portions of the lamp. The lamp can be tube-like in shape and can include an optical system that has at least two ellipse group reflecting surfaces that are combined to form a multi-reflex optical system. An aperture can be formed by the reflecting surfaces to allow light rays to be guided outside of the lamp. A light source is preferably located on a common first focus of the at least two ellipse group reflecting surfaces. One of the ellipse group reflecting surfaces can have a longer focal distance than, and a different longitudinal direction from, those of other ellipse group reflecting surface(s). An inner reflecting surface portion can be provided on a first of the ellipse group reflecting surfaces for directing light rays, which were traveling towards a second focus of a second of the ellipse group reflecting surfaces, towards the second focus of the first ellipse group reflecting surface(s), thereby forming a complex second focus of the lamp. The aperture is preferably located around the complex second focus.

27 Claims, 4 Drawing Sheets

VEHICLE LAMP

This invention claims the benefit of Japanese Patent Application No. HEI 2000-097012, filed on Mar. 31, 2000, which is hereby incorporated by reference.

BACKGROUND OF THE INVENTION

1. Field of the Invention

The invention relates to a vehicle lamp for use in the illumination of a headlamp, etc., and more particularly relates to a vehicle lamp forming a light distribution characteristic in a multi-reflex manner using an ellipse group reflector and a parabolic group reflector. The vehicle lamp can have relatively small width and depth in a front view, and is particularly suited for being in disposed along a side comer of a vehicle, rather than the front end.

2. Description of the Related Art

In accordance with recent vehicle design trends which pursue improvement of energy consumption efficiency by decreasing air resistance while traveling, a vehicle headlamp is often required to have a wedge-like shape in side view with a front end that is lower than the rear end, and/or to have a substantially elliptic shape in front view with front and rear ends that are narrowed. FIG. 5 shows the positioning of automobile headlamps 80 or 90 disposed in an automobile body 70 made in accordance with current fashionable design. In this design automobile headlights 80 and 90 are assigned to relatively larger spaces at right and left sides rather than right and left front ends of the automobile body 70.

Conventional automobile headlights cannot include the above-mentioned current design trend for automobile bodies while also satisfying light distribution pattern requirements.

FIG. 6 shows a conventional automobile headlamp 90 that has parabolic group reflecting surfaces 91*a* and 91*b*, e.g., rotated parabolic surfaces. Since the width of a front lens 92 as viewed from the front is small, the automobile headlamp 90 is required to have a larger reflecting area at its sides to compensate for the reduced width, and to obtain a predetermined light amount as required by regulation. In the automobile headlamp 90, the reflecting surface 91*a*, as shown in dotted lines, is located in a backward orientation. Accordingly, the reflecting surface 91*a* provides insufficient space for the wheel tire housing. If the reflecting surface 91*b*, which is located forward of reflecting surface 91*a*, is used for solving the space incompatibility problem with wheel tire housing, the total light amount produced by the automobile headlamp 90 decreases as the total area of reflecting surface of the automobile headlamp 90 decreases Furthermore, a blind/shade 93 must be used to avoid making the back surface of the reflecting surface 91*b* visible through the front lens 92, which deteriorates the aesthetic appearance of the automobile headlamp 90.

FIG. 7 shows another conventional automobile headlamp 80 that has an ellipse group reflecting surface 81, e.g., a rotated elliptic surface. Automobile headlamps having rotated elliptic group reflecting surfaces tend to have a relatively large depth, and therefore competition for space with tire wheel housing is significant. Accordingly, the ellipse group reflecting surface 81 must be located forward, and a blind/shade 83 is required to conceal a projection lens 82 from being visible through the front lens of the automobile headlamp 80, which would deteriorate the aesthetic appearance of the automobile headlamp 80.

SUMMARY OF THE INVENTION

In order to resolve the aforementioned problems in the related art, the present invention can include a tube-like lamp element having a multi-reflex optical system with at least two ellipse group reflecting surfaces that are combined to form a multi-reflex optical system with an aperture from which light rays are guided outside of the tube-like lamp element. A light-source can be located on a common first focus of the at least two ellipse group reflecting surfaces. One of the at least two ellipse group reflecting surfaces can have a longer focal distance than other ellipse group reflecting surface(s), and can have a different longitudinal direction than other ellipse group reflecting surface(s). In addition, a second one of the at least two ellipse group reflecting surfaces can have an inner reflecting surface portion for directing light rays, which were previously traveling towards a second focus of a first one of the ellipse group reflecting surfaces, towards a second focus of the second of the ellipse group reflecting surface(s); thereby forming a complex second focus of the tube-like lamp. The aperture formed by the ellipse group reflecting surfaces is preferably located around the complex second focus.

A lamp according to the invention can include two or more tube-like lamp elements having a multi-reflex optical system with a common light source located on the first focus of each tube-like lamp element.

The invention can also include a vehicle lamp that has a multi-reflex optical system which includes a parabolic group surface reflector and a front lens. The lamp can include at least one tube-like lamp element that is configured as described above, such that light rays emitted from the aperture are directed to the parabolic group surface reflector. One of the aperture, parabolic group surface reflector, or front lens can be configured to give predetermined forms to the light distribution patterns of the vehicle lamp.

DETAILED DESCRIPTION OF THE PREFERRED EMBODIMENTS

Figure 1:
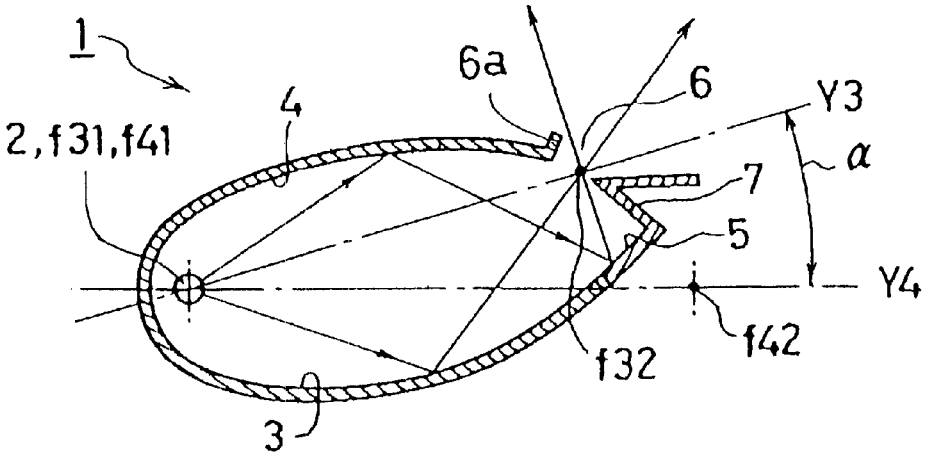
FIG. 1 is a longitudinal cross sectional view showing a lamp element having a multi-reflex system according to a preferred embodiment of the invention.
Figure 2:
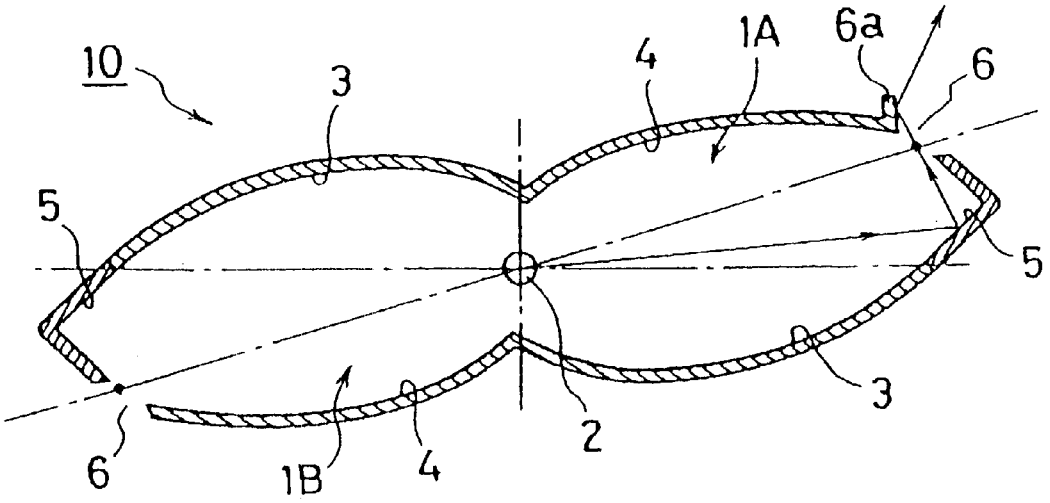
FIG. 2 is a longitudinal cross sectional view showing a lamp element having a multi-reflex system according to another preferred embodiment of the invention.

Detailed description of the present invention will now be given based on exemplary embodiments shown in the drawings FIG. 1 shows a tube-like lamp element 1 that has a multi-reflex optical system according to a preferred embodiment of the present invention. FIG. 2 shows a tubelike lamp element 10 that has a multi-reflex optical system including tube-like lamp elements 1A and 1B, which are each configured similar to lamp element 1. The number of tube-like lamp elements that comprise lamp element 10 is not limited to two, and may include one or more tube-like lamp elements.

The tube-like lamp element 1 is able to guide light rays from a light source 2 into a predetermined position and with a focused image of the light source 2. The lamp element 1 is intended to be a substantial light source of the vehicle lamp 20. The tube-like lamp 1 with multi-reflex optical system can include a light source 2, at least two ellipse group reflecting surfaces i.e., a direct focus elliptic reflecting surface 3 and an indirect focus elliptic reflecting surface 4, an inner reflecting surface portion 5, an aperture 6 through which light rays from the light source 2 travel outside of the tube-like lamp element 1, and a shutter 7 which may be disposed in the vicinity of the aperture 6 if necessary. An ellipse group reflecting surface can include a curved surface having an ellipse or its similar shape as a whole, such as a rotated elliptic surface, a complex elliptic surface, an elliptical free-curved surface, or combination thereof.

The direct focus elliptic reflecting surface 3 can include: an ellipse group reflector, such as a rotated elliptic surface having a longitudinal axis Y3 oriented in a predetermined direction; a first focus f31 located on the light source 2; and a second focus f32 located in the vicinity of the aperture 6. Both the first focus f31 and the second focus f32 are preferably located on the longitudinal axis Y3. Accordingly, light rays from the light source 2 focus towards the second focus f32.

The indirect focus elliptic reflecting surface 4 can include: an ellipse group reflector, such as a rotated elliptic surface having a longitudinal axis Y4 which has a predetermined angle a relative to the longitudinal axis Y3; a first focus f41 located on the light source 2; and a second focus f42. A focal distance between the first focus f41 and the second focus f42 is preferably larger than a focal distance between the first focus f31 and the second focus f32.

The direct focus elliptic reflecting, surface 3 and the indirect focus elliptic reflecting surface 4 can be located such that they surround substantially all of the periphery of the light source 2. Accordingly, additional light focused towards the second foci f42 and f32 is substantially equal to the light amount emitted from the light source 2. This configuration confines substantially all light rays from the light source 2 within the tube-like lamp element 1, and also guides the light rays outside of the tube-like lamp element 1 through aperture 6.

The inner reflecting portion 5 can be located along the light passageway between the indirect focus elliptic reflecting surface 4 and the second focus f42. The inner reflecting portion 5 has a predetermined curvature or angle for reflecting the light rays from the indirect focus elliptic reflecting surface 4 such that the reflected image of light rays reflected by the inner reflecting surface 5 focuses in the vicinity of the second focus f32 of the direct focus elliptic reflecting surface 3 The second focus f32 of the direct focus elliptic reflecting surface 3 functions as a complex second focus of the tube-like lamp element 1. Accordingly, the light amount that is focused around the second focus f32 of the direct focus elliptic reflecting is substantially equal to the light amount emitted from the light source 2. Luminous flux from the direct focus elliptic reflecting surface 3 and from the indirect focus elliptic reflecting surface 4 intersect around the complex second focus f32. By adjusting the intersecting angle formed between each luminous flux (from the direct focus elliptic reflecting surface 3 and from the indirect focus elliptic reflecting surface 4) a luminous flux having a desired illumination angle and direction from the aperture 6 can be obtained. If the desired illumination angle is small, the area of aperture 6 may be narrowed. In addition, a hood 6*a* for limiting the illumination angle may be provided. If a hood 6*a* having an interior mirrored surface is used, light rays blocked by the hood 6*a* are reflected to a predetermined position. e.g., inward of the tube-like lamp element 1, and are not wasted.

The configuration of tube-like lamp element 1 provides luminous flux that has a desired illumination angle and direction around the aperture 6. In order to achieve this result, the indirect focus elliptic reflecting surface 4 may include a plurality of ellipse group reflecting surface portions each having its longitudinal axis along the longitudinal axis Y4. The inner reflecting surface portion 5 may include a plurality of surface portions, e.g., a number of ellipse group reflecting surface portions corresponding to the number of reflecting surface portions that make up the indirect elliptic reflecting surface 4. The direct focus elliptic reflecting surface 3 may include a plurality of ellipse group reflecting surface portions, each having its longitudinal axis along the longitudinal axis Y3.

Figure 3:
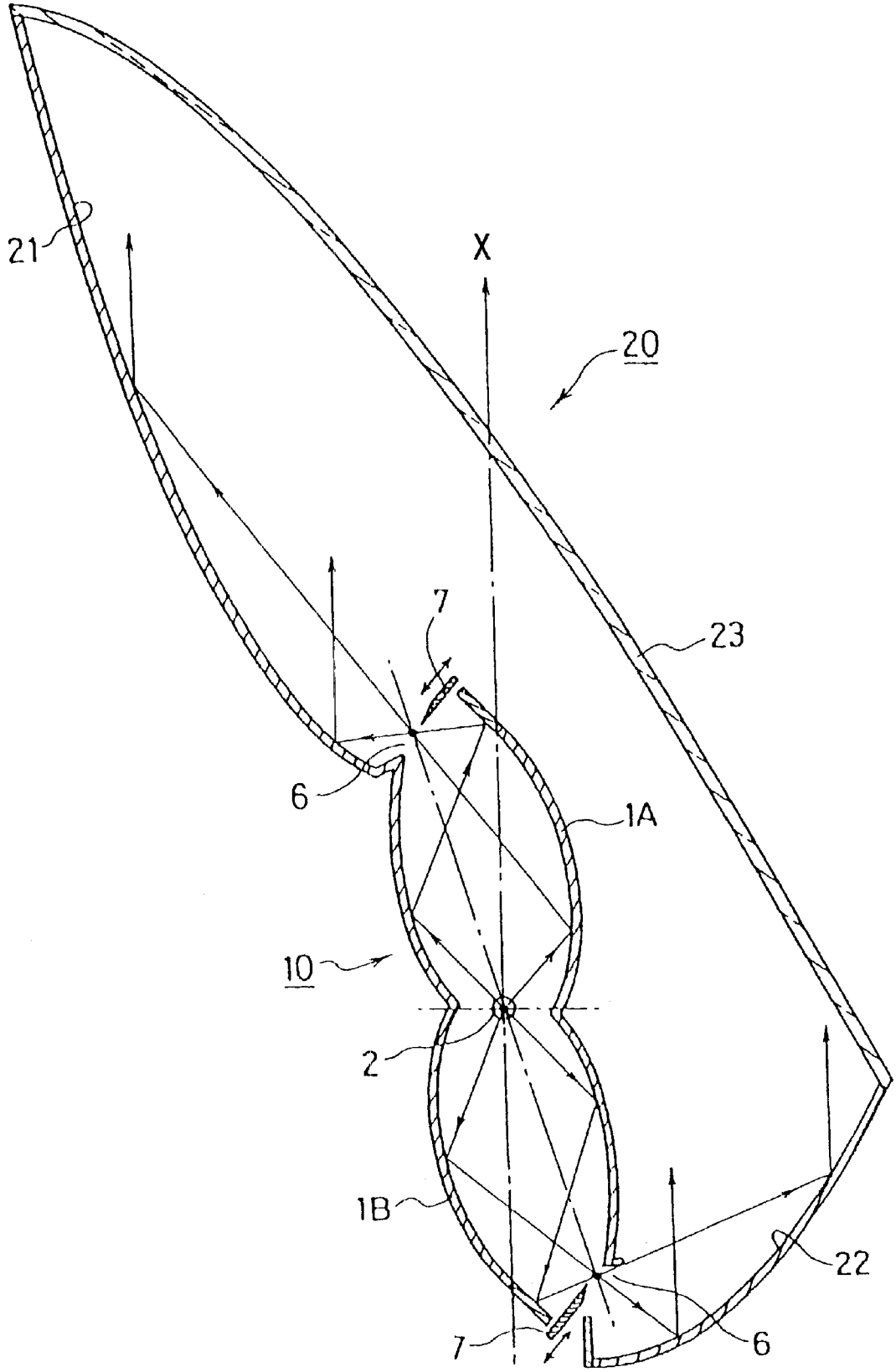
FIG. 3 is a cross sectional view along a horizontal longitudinal direction of a vehicle lamp that includes a lamp element having a multi-reflex system, in accordance with another preferred embodiment of the invention.

FIG. 2 illustrates a lamp element 10 that includes a lamp element 1A and a lamp element 1B having a multi-reflex system. Lamp elements 1A and 1B can be configured similar to the tube-like lamp element 1, as described above. The lamp elements 1A and 1B can be connected substantially linearly and share a light source 2. The lamp element 10 has apertures 6 at both ends along a longitudinal axis of the lamp element 10. In FIG. 2, the lamp elements 1A and 1B are arranged to be symmetric with respect to the light source 2. However, the lamp elements 1A and 1B may also be configured to be symmetric with respect to a line passing through the light source 2 to comply with different design requirements, e.g., for vehicle lamp 20 as shown in FIG. 3, which is described later in detail. Furthermore, the number of lamp elements of the lamp element 10 is not limited to two. For example, several lamp elements 1 may be arranged in a radial configuration in order to deliver light rays from one light source to a plurality of illumination targets via optical fibers or the like.

FIG. 3 illustrates a vehicle lamp 20 that includes: the lamp element 10 as described above; a parabolic group reflecting surface 21 such as a rotated parabolic surface having a focus around an aperture 6 of the lamp element 10, a parabolic group reflecting surface 22 having a focus around another aperture 6 of the lamp element 10; and a front lens 23. The longitudinal axes of the parabolic group reflecting surfaces 21 and 22 can be substantially parallel to a longitudinal axis X, i.e., an illumination direction of the vehicle lamp 20. The term parabolic group reflecting surface can be defined as a curved surface having a parabola or similar shape as a whole, such as a rotated parabolic surface, a complex parabolic surface, paraboloidal surface, a parabolic free-curved surface, or combination thereof. The number of tube-like lamp elements 1A or 1B in the vehicle lamp 20 is not limited to two. The vehicle lamp element 10 may also include one or more lamp element(s).

The second foci of lamp elements 1A and 1B of the lamp element 10 are preferably located in the vicinity of the respective aperture 6 of the lamp element 1A and 1B, and function as respective light sources for the parabolic group reflecting surfaces 21 and 22. Accordingly, light rays reflected by the parabolic group reflecting surfaces 21 and 22 are directed approximately parallel to the illumination direction X of the vehicle lamp 20. Desired light distribution patterns of the vehicle lamp 20 may be obtained by adjusting the parabolic group reflecting surfaces 21 and 22, or by lens cuts (not illustrated herein) on the front lens 23, or by a combination thereof. For example, if the parabolic group reflecting surfaces 21 and 22 are each formed by a combined paraboloidal surface, desired light distribution patterns can be obtained by adjusting the shape and curvature of each element of the combined paraboloidal surface.

The apertures 6 can have complex second foci functioning as respective light sources for the parabolic group reflecting surfaces 21 and 22. Therefore, a shutter 7 (which can act as a shade or a hood member) may be arranged in the vicinity of at least one aperture 6 to form desired light distribution patterns.

In the vehicle headlamp 20. a movable shutter 7 can be disposed around each aperture 6. When each movable shutter 7 is located in its low-beam position. a low-beam light distribution pattern (low-beam mode) is formed. The low-beam is formed by prohibiting a portion of light rays that are reflected towards a certain upward illumination direction of the vehicle headlamp 20 by the parabolic group reflecting surfaces 21 or 22. The certain upward reflected light rays are not required for formation of the low-beam light distribution pattern. Each movable shutter 7 is located around the respective second foci f32 of the ellipse group reflecting surfaces of lamp elements 1A and 1B of the lamp element 10. Accordingly, it is possible to form a low-beam light distribution pattern with a clear bright-dark boundary by adjusting the shape and position of the movable shutter 7.

Figure 4:
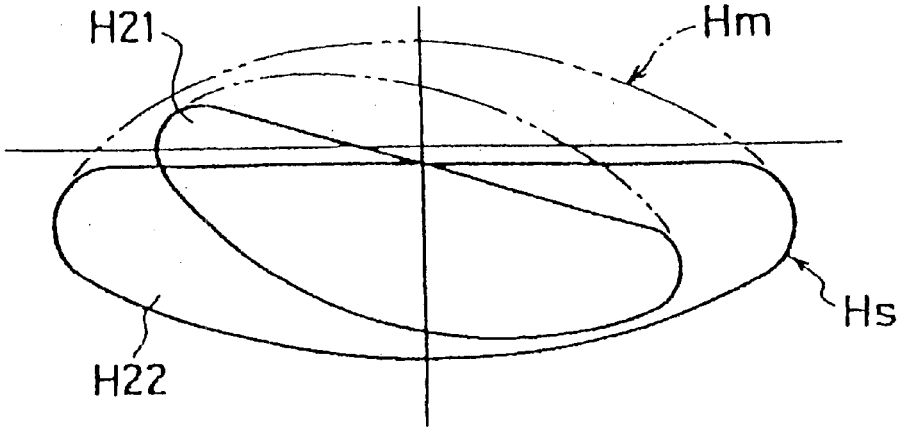
FIG. 4 is a view illustrating light distribution patterns relative to elements of a vehicle lamp made in accordance with a preferred embodiment of the invention.
Figure 5:
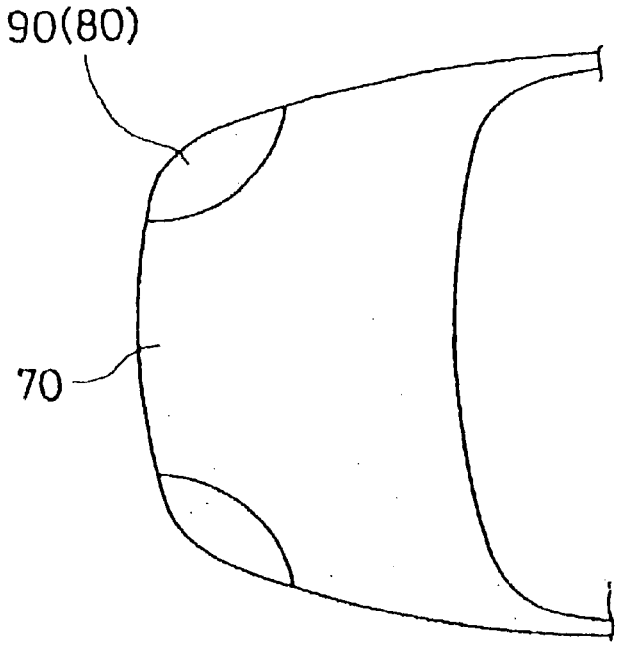
Fig.5 CONVENTIONAL ART
FIG. 5 is a top view of a conventional vehicle illustrating the current fashionable design for the positional relationship between the vehicle headlamps and the vehicle body.
Figure 6:
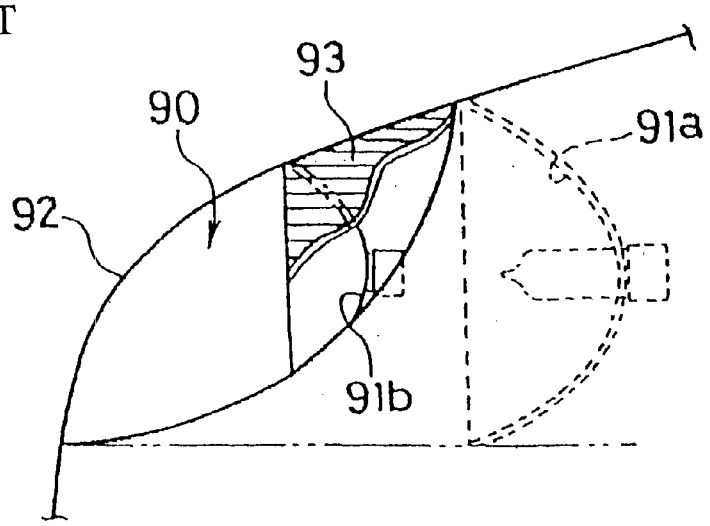
Fig.6 CONVENTIONAL ART
FIG. 6 is a partial cross-sectional top view of a vehicle showing the position of a conventional automobile headlamp that has a parabolic group reflecting surface.
Figure 7:
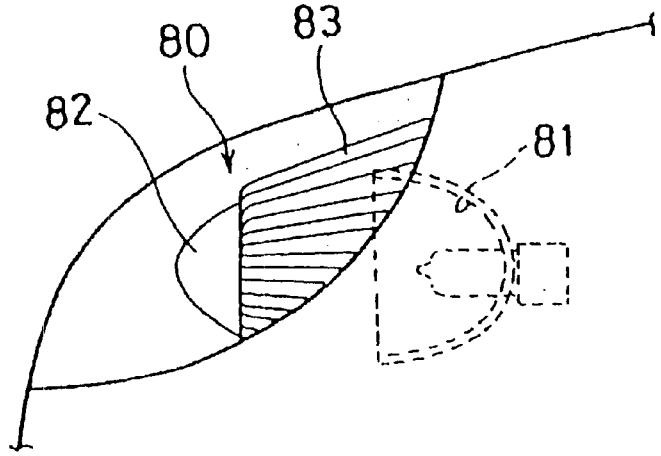
Fig.7 CONVENTIONAL ART
FIG. 7 is a partial cross-sectional top view of a vehicle showing the position of another conventional vehicle headlamp that has an ellipse group reflecting surface.

FIG. 4 illustrates light distribution patterns as formed by respective elements of the vehicle lamp 20. Solid line Hs depicts a low-beam light distribution pattern (low-beam mode), and results from a combination of light distribution patterns H21 and H22 as shown in solid lines A dotted line Hm represents the light distribution pattern formed by H21 and H22 as shown in dotted line and solid line portions, and corresponds to a light distribution pattern in high-beam mode. When using a low-beam light distribution pattern Hs, a movable shutter 7 located around the aperture 6 of the lamp element 1A can be designed such that light rays, which have passed through the aperture 6 and were reflected by the parabolic group reflecting surface 21, form a light distribution pattern H21 as shown in solid line when the movable shutter 7 is in its low-beam mode position. For a vehicle that is normally driven on the left lane, the light distribution pattern H21 as shown in solid line can have a bright-dark boundary inclined towards the upper left by 15 degrees relative to a horizontal axis of the light distribution pattern. For a vehicle that is normally driven on the right lane, the light distribution pattern H21 as shown in solid line has a bright-dark boundary inclined towards the upper right by 15 degrees relative to the horizontal axis of the light distribution pattern.

A movable shutter 7 located around the aperture 6 of the lamp element 1B can be designed such that light rays, which have passed through the aperture 6 and were reflected by the parabolic group reflecting surface 22. form a light distribution pattern H22 as shown in solid line, when the movable shutter 7 is in its low-beam mode position. The light distribution pattern H22 as shown in solid line has a horizontal bright-dark boundary and includes light rays that are directed downward. The light distribution patterns H21 and H22 as shown in solid lines are combined to form a low-beam light distribution pattern Hs which is asymmetrical with respect to a vertical axis of the light distribution pattern, and has a portion known as an "elbow" for illuminating the roadside.

When the lamp is in the high-beam mode, each movable shutter 7 can be located in its high-beam mode position such that light rays from the light source 2 pass through each aperture 6 without being prohibited by the corresponding movable shutter 7. Accordingly, reflected light rays from the parabolic group reflecting surfaces 21 and 22 include upwardly directed light rays such that light distribution patterns H21 and H22 respectively include respective upper portions outlined by respective dotted lines and solid lines in FIG. 4. By combining these light distribution patterns H21 and H22, a traveling high-beam light distribution pattern Hm that has long distance visibility can be obtained.

The lamp element 10 may also be designed to have a relatively increased amount of downwardly directed light rays from the vehicle lamp 20. In such a case, even when the movable shutter 7 is located in its high-beam position, there is a relatively high ratio of light rays illuminating downwards with respect to the entire light amount produced by the vehicle lamp 20.

As a result, it is possible that areas close to a vehicle may be brightly illuminated, and it may be difficult to obtain a sufficient level of long distance visibility in high-beam mode.

When the light distribution pattern is changed between low-beam mode and high-beam mode, the entire vehicle lamp element 10, or a portion of lamp elements 1A and 1B, may be moved with the movable shutter 7 for directing light rays that travel to the parabolic group reflecting surfaces 21 and 22 and toward the front of the vehicle lamp 20. More specifically, one of the direct focus ellipse group reflecting surface 3, indirect focus ellipse group reflecting surface 4 or inner reflecting surface portion 5 may be moved together with the movable shutter 7 to emphasize the difference between the low-beam mode and high-beam mode.

In the vehicle lamp 20, substantially all light rays emitted from the light source 2 are directed through the apertures 6 toward the parabolic group reflecting surfaces 21 and 22. When the light rays pass through the apertures 6, the light rays are focused to provide a luminous flux at a predetermined position, direction, and distribution by a combination of the direct focus reflecting surface 3, indirect focus reflecting surface 4 and the inner reflecting surface portion 5.

The vehicle lamp 20 is thus configured such that it is able to be incorporated in a vehicle body having a headlamp space that has a small width as viewed from the front and a relatively small depth as viewed from the side of the vehicle body. The conventional vehicle lamp 80 or 90 is not able to provide sufficient light amount in its illumination direction when the headlamp space is configured in such a manner. In order to obtain sufficient light amount by the conventional vehicle lamps 80 or 90, there is no way to provide the level of depth to the conventional vehicle lamps 80 or 90 necessary to have sufficient reflecting surface area while having sufficient space for the wheel tire housing. By contrast, in the present invention, since the vehicle lamp 20 is able to provide substantially all light rays from the light source 2 through apertures 6 to its illumination direction, sufficient light amount is obtained in its illumination direction even when the total area of the reflecting surface of the vehicle lamp 20 is small. Accordingly, the area, position and shape of reflecting surface(s) of the vehicle lamp 20, and specifically parabolic group reflecting surfaces 21 and 22, can be configured with great design flexibility.

The operational advantages of the present invention will now be described. In the above description, a tube-like lamp element 1 can have a multi-reflex optical system that includes at least two ellipse group reflecting surfaces 3 and 4 that are combined to form an aperture 6 from which light rays are guided outside of the tube-like lamp element 1. A light source 2 can be located on a common first focus f31 and f41 of ellipse group reflecting surfaces 3 and 4, and the ellipse group reflecting surfaces 3 and 4 can be combined to form the tube-like shape of the lamp element 1. The ellipse group reflecting surface 4 can have a longer focal distance than, and a different longitudinal direction from, those of the ellipse group reflecting surface 3. The ellipse group reflecting surface 3 can have an inner reflecting surface portion 5 for directing light rays (which originally traveled towards second focus f42 of the ellipse group reflecting surface 4) towards second focus f32 of the ellipse group reflecting surface 3, thereby forming a complex second focus of the tube-like lamp element 1. The aperture 6 can be located around the complex second focus.

The lamp element 10 can have a multi-reflex optical system that includes lamp elements 1A and 1B which are configured similar to the tube-like lamp element 1 and can have a common light source 2 located on the first focus of each lamp element 1A and 1B.

A vehicle lamp 20 including a lamp element 10 having at least one lamp element 1A and 1B as described above includes respective aperture(s) 6 that function as light sources for the vehicle lamp 20. The vehicle lamp 20 can include parabolic group reflecting surfaces 21 and 22, and a front lens 23, wherein one of the aperture 6, parabolic group reflecting surfaces 21 and 22, or front lens 23, or combination thereof is designed to give predetermined forms to light distribution patterns of the vehicle lamp 20.

The lamp element 1 and the lamp element 10 are able to focus light rays from their common light source 2 to the vicinity of their aperture 6, and provide luminous flux having a predetermined shape, position, direction and radiation angle toward parabolic group reflecting surfaces 21 and 22 of the vehicle lamp 20. This configuration for the vehicle lamp 20 enables the vehicle lamp to have a small width as viewed from the front of the vehicle and a small depth as viewed from the side of the vehicle body as compared to conventional vehicle lamps such as vehicle lamps 80 or 90. The configuration also provides a sufficient amount of light in the lamp's illumination direction, which would be difficult and/or impossible to do with the conventional vehicle lamps 80 or 90. Furthermore, since the vehicle lamp 20 does not require a blind or shade 83 or 93, the vehicle lamp 20 greatly improves the aesthetic appearance of a vehicle.

The light source 2 can be formed by many different types of light sources, including halogen, high intensity discharge, light emitting diode, incandescent, fluorescent and other types to of lamps. The vehicle lamp could be incorporated into the side of boat hulls and or other vehicles to provide lighting while keeping an aerodynamic and relatively small spatial profile. The material of the reflecting surfaces can be selected from any known reflective material, including metals, plastics, ceramics, rubbers, fiber based materials, as well as materials that are coated with a reflective coating. The lens 23 can be clear or can include shapes that diffuse and/or redirect light. For example, the lens 23 can include a plurality of grooves or extrusions that redirect and diffuse light emitted from the light source. These same grooves and/or extrusions would also distort or block the view of the inner structure of the lamp from the exterior of the lamp.

The shutter 7 can also be formed from various materials and include various types of coatings. The shutter can be made of materials that are opaque, non-opaque, reflective or non-reflective, depending on the desired effect on the light distribution. The degree of opaqueness or reflectivity can also be changed.

It will be apparent to those skilled in the art that various changes and modifications can be made herein without departing from the spirit and scope of the invention. Thus, it is intended that the invention cover modifications and variations of the invention provided they come within the scope of the appended claims and their equivalents.

What is claimed is:

1. A lamp having a multi-reflex optical system, comprising:

at least two ellipse group reflecting surfaces, each of the reflecting surfaces having a first focus and a second focus, a light source located substantially on the first focus of one of the at least two ellipse group reflecting surfaces; and an aperture from which light rays are guided outside of the lamp, wherein a first of the ellipse group reflecting surfaces has a longer focal distance than that of a second of the ellipse group reflecting surfaces, and has a different longitudinal direction than that of the second of the ellipse group reflecting surfaces, the second of the ellipse group reflecting surfaces has an inner reflecting surface portion that is configured to direct light rays, which were previously traveling towards the second focus of the first of the ellipse group reflecting surfaces, approximately towards the second focus of the second of the ellipse group reflecting surfaces, thereby forming a complex second focus for the optical system, and the aperture is located at approximately the same location as the complex second focus.

2. The lamp according to claim 1, wherein the at least two ellipse group reflecting surfaces form a tube-like lamp element.

3. The lamp according to claim 1, wherein the first foci of the at least two ellipse group reflecting surfaces are located at substantially the same position.

4. The lamp according to claim 1, further comprising:

a shutter located at approximately the same location as the aperture for giving a desired shape to luminous flux around the aperture.

5. A lamp having at least two lamp elements with a multi-reflex optical system, comprising:

at least two ellipse group reflecting surfaces located at each of the lamp elements, each of the ellipse group reflecting surfaces having a first focus and a second focus;

a light source located at approximately the same location as the first focus of one of the ellipse group reflecting surfaces of each of the lamp elements; and an aperture located on each of the lamp elements from which light rays are guided outside of each of the lamp elements, wherein a first of the ellipse group reflecting surfaces of each of the lamp elements has a longer focal distance than that of a second of the ellipse group reflecting surfaces, and has a different longitudinal direction than that of the second of the ellipse group reflecting surfaces, the second of the ellipse group reflecting surfaces for each of the lamp elements has an inner reflecting surface portion positioned to direct light rays, which were traveling towards the second focus of the first of the ellipse group reflecting surfaces, approximately towards the second focus of the second of the ellipse group reflecting surfaces for each of the lamp elements, thereby forming a complex second focus for each of the lamp elements;

wherein the aperture located on each of the lamp elements is located at approximately the same location as the complex second focus for each of the lamp elements.

6. The lamp according to claim 5, wherein the at least two lamp elements each have a tube-like shape.

7. The lamp according to claim 5, wherein the first foci of the at least two ellipse group reflecting surfaces are located at substantially the same position for each of the lamp elements.

8. The lamp according to claim 5, wherein the complex second foci of the at least two lamp elements are substantially equidistant from the light source.

9. The lamp according to claim 5, wherein the complex second foci of the at least two lamp elements are positioned relative to an axis of symmetry passing through the light source.

10. The lamp according to claim 5, further comprising:

a shutter located approximately at the aperture of one of the lamp elements for giving a desired shape to luminous flux around the aperture.

11. A vehicle lamp having a multi-reflex system, comprising:

a reflector having an opening;

a lens located adjacent the opening of the reflector; and at least two lamp elements configured to provide light rays to the reflector from at least one aperture located on one of the lamp elements, wherein the lamp elements include, at least two ellipse group reflecting surfaces, each ellipse group reflecting surface having a first focus and a second focus, a light source located at approximately the same location as the first focus of one of the at least two ellipse group reflecting surfaces, wherein a first of the ellipse group reflecting surfaces has a longer focal distance than that of a second of the ellipse group reflecting surfaces, and has a different longitudinal direction than that of the second of the ellipse group reflecting surfaces, the second of the ellipse group reflecting surfaces has an inner reflecting surface portion positioned to direct light rays, which were traveling towards the second focus of the first of the ellipse group reflecting surfaces, approximately towards the second focus of the second of the ellipse group reflecting surfaces, thereby forming a complex second focus;

wherein the aperture is located approximately at the complex second focus of at least one of the lamp elements.

12. The lamp according to claim 11, wherein the at least two ellipse group reflecting surfaces form a tube-like lamp element.

13. The lamp according to claim 11, wherein the first foci of the at least two ellipse group reflecting surfaces are located at substantially the same position.

14. The vehicle lamp according to claim 11, wherein each of the lamp elements includes a complex second focus, and the complex second foci of the lamp elements are substantially equidistant from the light source.

15. The vehicle lamp according to claim 11, wherein each of the lamp elements includes a complex second focus, and the complex second foci of the lamp elements are positioned relative to an axis of symmetry passing through the light source.

16. The vehicle lamp according to claim 11, further comprising:

a shutter located approximately at the aperture of the lamp elements for giving a desired shape to luminous flux around the aperture.

17. The vehicle lamp according to claim 16, wherein the shutter is movable and a light distribution pattern of the vehicle lamp is changed by movement of the shutter.

18. The vehicle lamp according to claim 16, wherein one of the inner reflecting surface portion and the ellipse group reflecting surfaces of one of the lamp elements is movable together with the shutter to change the light distribution pattern.

19. The vehicle lamp according to claim 11, wherein the reflector includes a parabolic group reflecting surface.

20. The vehicle lamp according to claim 19, wherein the complex second focus of the lamp elements is located at approximately a focus of the parabolic group reflecting surface.

21. A vehicle lamp having a multi-reflex optical system, comprising:

at least two ellipse group reflecting surfaces each having a first focus and a second focus;

a light source located approximately at a first focus of one of the at least two ellipse group reflecting surfaces;

wherein a first of the ellipse group reflecting surfaces has a longer focal distance than that of a second of the ellipse group reflecting surfaces, and has a different longitudinal direction than that of the second of the ellipse group reflecting surfaces;

the second of the ellipse group reflecting surfaces has an inner reflecting surface portion positioned to direct light rays, which were traveling towards the second focus of the first of the ellipse group reflecting surfaces, approximately towards the second focus of the second of the ellipse group reflecting surfaces, thereby forming a complex second focus;

an aperture located approximately at the same location as the complex second focus;

a reflector having an opening and a focus located at approximately the same location as the aperture; and a lens located adjacent the opening of the reflector.

22. The lamp according to claim 21, wherein the at least two ellipse group reflecting surfaces form a tube-like lamp element.

23. The lamp according to claim 21, wherein the first foci of the at least two ellipse group reflecting surfaces are located at substantially the same position.

24. The lamp according to claim 21, further comprising:

a shutter located at approximately the same location as the aperture for giving desired shape to luminous flux around the aperture.

25. The vehicle lamp according to claim 24, wherein the shutter is movable and a light distribution pattern of the vehicle lamp is changeable by movement of the shutter.

26. The vehicle lamp according to claim 25, wherein one of the inner reflecting surface portion and the at least two ellipse group reflecting surfaces is movable together with the shutter to change the light distribution pattern of the lamp.

27. The vehicle lamp according to claim 21, wherein the reflector includes a parabolic group reflecting surface.

* * * * *